US008430657B2

(12) United States Patent
Simonelli et al.

(10) Patent No.: US 8,430,657 B2
(45) Date of Patent: Apr. 30, 2013

(54) PUMP HAVING MODULAR SHAFT BEARINGS AND SEALS

(75) Inventors: James K. Simonelli, Buford, GA (US); Michael A. Ingram, Statham, GA (US); Laney A. Seabolt, Commerce, GA (US)

(73) Assignee: Roper Pump Company, Commerce, GA (US)

( * ) Notice: Subject to any disclaimer, the term of this patent is extended or adjusted under 35 U.S.C. 154(b) by 803 days.

(21) Appl. No.: 12/640,036

(22) Filed: Dec. 17, 2009

(65) Prior Publication Data

US 2010/0150764 A1 Jun. 17, 2010

Related U.S. Application Data

(60) Provisional application No. 61/138,377, filed on Dec. 17, 2008.

(51) Int. Cl.
*F01C 19/00* (2006.01)
*F01C 1/18* (2006.01)

(52) U.S. Cl.
USPC ..... 418/104; 418/206.6; 418/206.7; 418/206.1

(58) Field of Classification Search ..... 418/104, 418/206.1–206.9
See application file for complete search history.

(56) References Cited

U.S. PATENT DOCUMENTS 1,751,703 A * 3/1930 Long ..... 418/102
1,762,708 A * 6/1930 Harvey ..... 415/72
1,923,268 A * 8/1933 Jensen ..... 418/206.1
3,133,506 A * 5/1964 Louis ..... 418/91
6,309,199 B1 10/2001 Devine

* cited by examiner

*Primary Examiner* — Hoang Nguyen
(74) *Attorney, Agent, or Firm* — Caesar, Rivise, Bernstein, Cohen & Pokotilow, Ltd.

(57) ABSTRACT

An external gear pump including seals, bearings, bushing/seal housings, choke collars and shafts that are all removable for maintenance and/or replacement without removing either endplate or internals from the case assembly. The preferred pump includes four bearing caps that can be removed without removing the pump from its mounted position. By removing the four bearing caps, access is gained inside the pump housing to all of the seals, bearings, bushing/seal housings, choke collars and most importantly, the drive and idler shafts within the pump housing. Further, the two shafts can be slipped out of the pump without disturbing the internal parts and endplates. This capability facilitates maintenance and replacement of major components without removing the pump from its mounted position.

16 Claims, 4 Drawing Sheets

PUMP HAVING MODULAR SHAFT BEARINGS AND SEALS

CROSS-REFERENCE TO RELATED APPLICATIONS

This application claims the benefit under 35 U.S.C. §119 (e) of U.S. Provisional Patent Application No. 61/138,377, filed on Dec. 17, 2008, entitled MODULAR SHAFT BEARING AND SEAL DESIGN TO FACILITATE REMOVAL OF THE SHAFTS FOR MAINTENANCE AND QUICK REBUILDS whose entire disclosure is incorporated by reference herein.

BACKGROUND OF THE INVENTION

1. Field of Invention

This invention relates generally to gear pumps, and more particularly, to an external gear pump capable of having seals, bearings and shafts maintained and/or replaced without removing the endplates or gears from the device.

2. Description of Related Art

Designs of devices such as external gear pumps typically require the pump to be removed from their mounted location and totally disassembled in order to replace major components such as shafts, bearings and bushing/seal housings. In addition many external gear pumps are designed in such a way that the pump would have to be removed from its mounted position in order to replace the seals, bearings, bushings and shafts. It would be a cost and efficiency benefit to maintain, inspect and replace these pump components without having to remove the pump from its mounted position or without having to disassemble endplates or internal parts such as the gears.

All references cited herein are incorporated herein by reference in their entireties.

BRIEF SUMMARY OF THE INVENTION

The present invention provides for removal of the bearing housing and replacement of seals, bearings, bushing/seal housings and choke collar on one end of one shaft without disassembly of the remaining parts of the pump; or removal of the bearing housings from both ends of one shaft and replacement of seals, bearings, bushing/seal housings, choke collars and/or the shaft held between the two bearing housings without disassembly of the remaining parts of the pump. By this invention, removal of the bearing housings, bearings, bushing/seal housings, seals and choke collar, opens a hole in the endplate and adjacent wearplate that is large enough to remove the shaft with its installed key and insert a new shaft with installed key without removing an endplate or adjacent wearplate. As in the general case of an external gear pump, the case, gears and endplates could remain assembled and located in the pumps' operational mounted location while maintenance or replacement of major parts is completed.

An example of the invention includes a pump having a modular shaft, bearing and seal design that can be removed while the pump remains in a mounted operating position. This pump includes a pump housing having a case, first and second endplates, first and second wearplates sandwiched between the case and respective endplate, and first and second bearing housings. The first and second endplates are attached to the case on opposite ends thereof and form an internal cavity for enclosing a gear. The first and second endplates have a channel and a plurality of endplate bores adjacent the channel, with the channel of the first endplate in axial alignment with the channel of the second endplate. The first and second bearing housings have an open end defining a bearing bore and an aperture adjacent the bearing bore and in alignment with one of the endplate bores. The first bearing housing is attached to the first endplate via a fastener extending through the aperture and coupling with the first endplate bore. The second bearing housing is attached to the second endplate via a fastener extending through the aperture and coupling with the second endplate bore. A drive shaft extends through the channels of the first and second endplates and into the first and second bearing housings. The drive shaft has a clearance fit within the gear and includes a key extending outwards into abutment with the gear to drive the gear. First and second bushings are positioned about the drive shaft, with the first bushing located between the drive shaft and the channel of the first endplate, and the second bushing located between the drive shaft and the channel of the second endplate. Detachment of a bearing housing from its respective endplate while the endplate remains attached to the case enables removal of the bushings adjacent the detached bearing housing. Preferably the bearing housing, ball bearing and bushing/seal assembly should be removed from the endplate on the opposite side of the case before the drive shaft can be removed.

Another example of the pump includes a pump housing having a case, first and second endplates, and a plurality of bearing housings. The first and second endplates are attached to the case on opposite ends thereof and form an internal cavity for enclosing a drive gear and an idler gear. The endplates have an upper channel, a lower channel and a plurality of endplate bores adjacent the upper and lower channels, with the channels of the first endplate in axial alignment with the channels of the second endplate. The bearing housings have an open end defining a bearing bore and apertures adjacent the bearing bore and in alignment with one of the endplate bores. The bearing housings are attached to the endplates via fasteners extending through the apertures of the bearing housings and coupling with the endplate bores. A drive shaft extends through the upper channels of the first and second endplates and into the respectively attached bearing housings, with the drive shaft having a clearance fit within the drive gear. The drive shaft includes a key extending outwards into abutment with the drive gear to drive the gear. An idler shaft extends through the lower channels of the first and second endplates and into the respectively attached bearing housings. The idler shaft fits within the idler gear. First and second bushings are located about the drive shaft, with the first bushing located between the drive shaft and the channel of the first endplate, and the second bushing located between the drive shaft and the channel of the second endplate. Third and fourth bushings are located about the idler shaft, with the third bushing located between the idler shaft and the channel of the first endplate, and the fourth bushing located between the idler shaft and the channel of the second endplate. Detachment of one of the bearing housings from their respective endplate while the endplate remains attached to the case exposes a respective shaft and enables removal of the bushings about the respective shaft adjacent the detached bearing housing. Preferably the bearing housing, ball bearing and bushing/seal assembly should be removed from the endplate on the opposite side of the case before the exposed shaft can be removed.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The present invention will now be described with reference to the accompanying drawings, in which preferred embodiments of the invention are shown. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Like numbers refer to like elements throughout.

While not being limited to a particular theory, the preferred pump described herein by example includes four bearing caps that can be removed without removing the pump from its mounted position. By removing the four bearing caps, access is gained inside the pump housing to all of the seals, bearings, bushing/seal housings, choke collars and most importantly, the drive and idler shafts within the pump housing. When the bearings, bushing/seal housings and seals are removed, the two shafts can be slipped out of the pump without disturbing the internal parts and endplates. This capability facilitates maintenance and replacement of major components without removing the pump from its mounted position. Down time and expense is significantly reduced for the pump.

Figure 1:
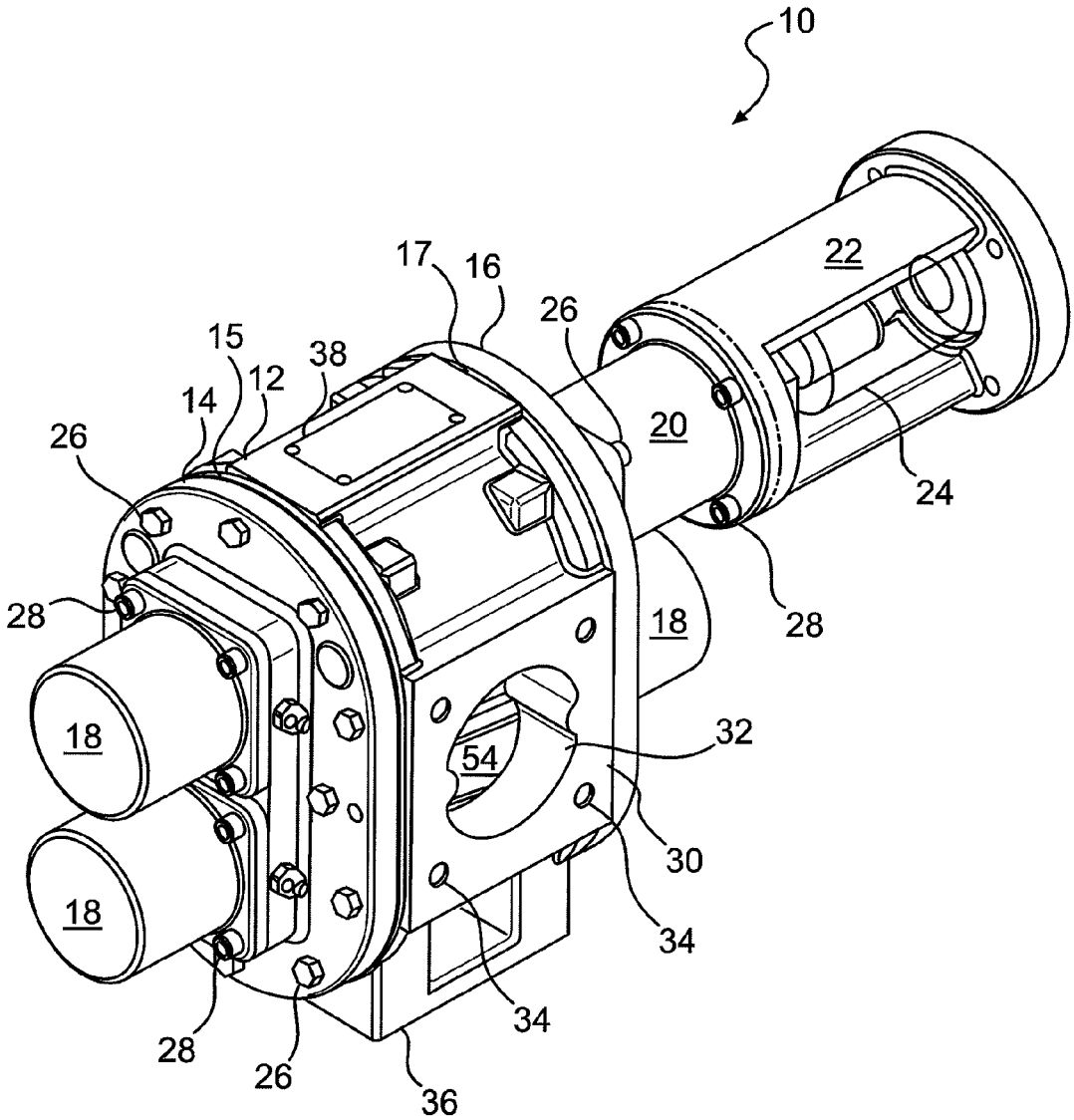
FIG. 1 is a perspective view of an exemplary pump in accordance with the preferred embodiments of the invention.
Figure 2:
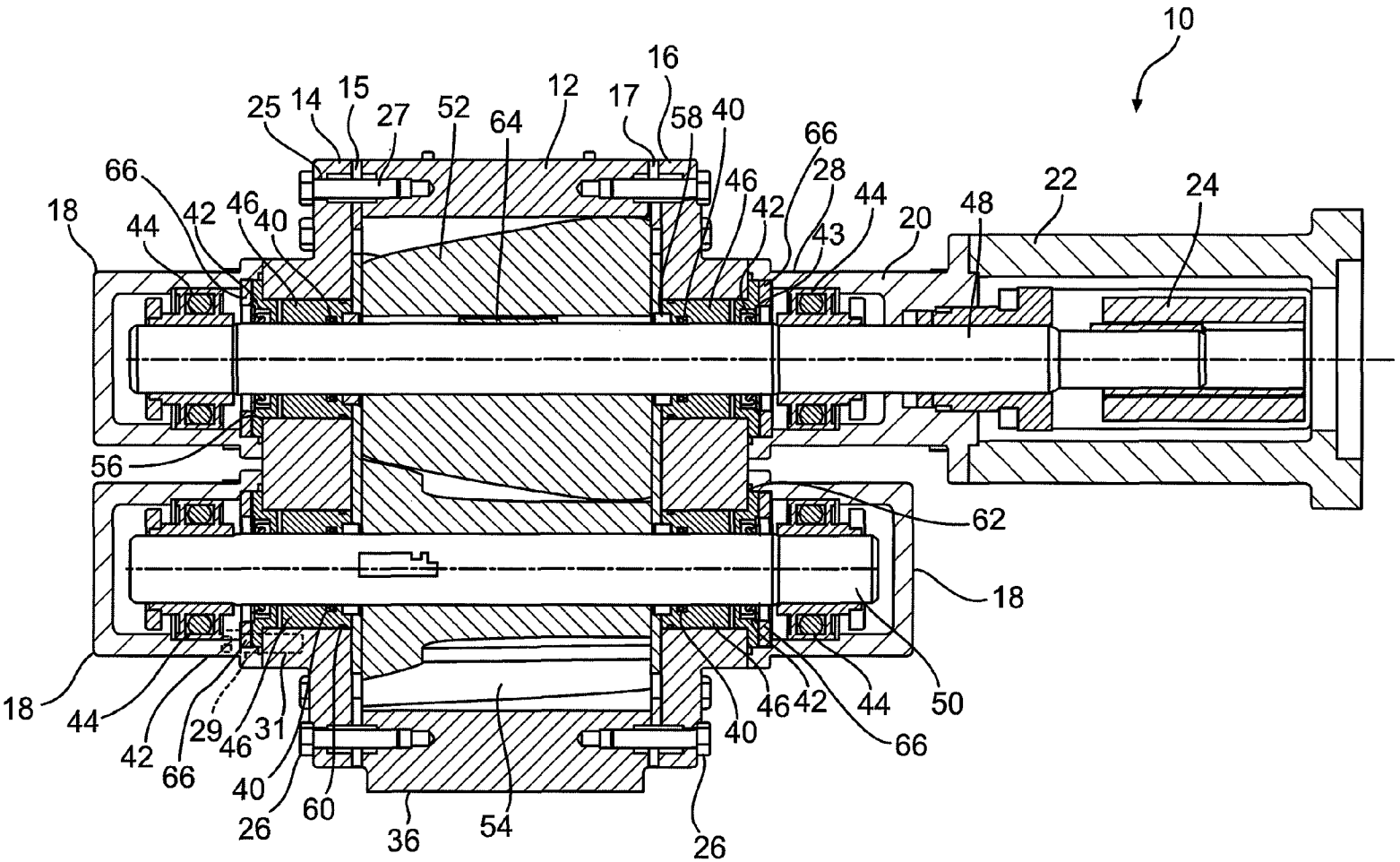
FIG. 2 is a side sectional view of the pump illustrated in FIG. 1.

FIG. 1 depicts an exemplary pump 10 in accordance with the preferred embodiments, and FIG. 2 is a cross-sectional view of the pump. The pump 10 includes a case 12, first and second endplates 14, 16, first and second wearplates 15, 17 and first and second types of bearing housings 18, 20 that form the pump housing enclosing the gears, seals, bearings, shafts, and bushings therein. The endplates 14, 16 are attached to the case at opposite ends thereof and enclose gears placed within the pump housing. As can best be seen in FIG. 1, an upper bearing housing and lower bearing housing, both first types of bearing housings 18, are shown coupled to the first end plate 14, with the upper bearing housing closer to a warning label 38 adhered to a top wall of the case 12, and the lower bearing housing closer to a support bracket 36 opposite the top wall. In this example, the second endplate 16 is coupled to a second type bearing housing 20 as another upper bearing housing close to the warning label 38. Below the second type bearing housing 20, another first type bearing housing 18 is also coupled to the second endplate 16 as another lower bearing housing. It will be understood by those skilled in the art that one or more of the bearing housings 18, 20 can be designed differently to allow other types of pump drive mechanisms to be attached or connected to the bearing housings. As an example, but not limited thereto, a mounting bracket 22 for a ridged coupling 24 that connects the pump shaft to the hydraulic motor could be made as part of or attached to the bearing housing 20. In this example, while the first type bearing housing 18 is blind or closed, the second type bearing housing 20 is opened opposite the endplate facing side and has a bore through its opened side which the end of a shaft 48 can protrude.

Referring to both FIGS. 1 and 2, the endplates 14, 16 and wearplaters 15, 17 are secured to the case via case fasteners 26 inserted through endplate apertures 25 and into case bores 27 as understood by a skilled artisan. The first and second endplates 14, 16 are preferably substantially the same, just attached to opposite ends of the case 12. This feature, while decreasing manufacturing cost, is not critical to the invention since the endplates may be shaped as necessary for accommodation of the seals, bearings, bushings within and attachments thereto while withstanding the pressures common in such pumps, as understood by a skilled artisan.

The bearing housings 18 and 20 are secured to their respective endplate 14, 16 via bearing housing fasteners 28. Preferably, the bearing housings include a series of bearing housing apertures 29 alignable with matching endplate bores 31 in either of the endplates when the bearing housing is fitted over a shaft 48, 50 and bearing 44 placed about the shaft to accept fasteners 28 that attach the bearing housing to the endplate. The bearing housings also include a groove at the junction of the bearing housing inner diameter and face of the endplate 14, 16 for accepting an o-ring 62 to seal the joint therebetween. While not being limited to a particular theory, the fasteners 26, 28 are preferably threaded (e.g., screws) and include a head shaped to receive a fastener removing tool (e.g. screwdriver, Allen wrench, socket wrench) having an end shaped to compliment and fit against the head of the fastener to remove or insert the fastener out of or into matching apertures and bores, which preferably are threaded, in the respective bearing housing, endplate, or case as discussed above. The bearing housing 20 and mounting bracket 22 are also attached by fasteners 28.

The case 12 includes a plate wall 30 having a port 32 extending through the plate wall for fluid communication with the interior of the housing. During operation the plate wall 30 is attached to an external device (e.g., conduit) preferably via fasteners extending from the device to bores 34 of the plate wall 30. For convenience the case 12 also includes a support bracket 36 for securing the pump to another device or unit to support the pump for its operational use as would be readily understood by a skilled artisan.

Referring to FIG. 2, the pump 10 encloses a modular shaft bearing and seal design that allows for quick removal and replacement of seals 40, 42, bearings 44 and bushings 46 or seal housings. The design also allows for removal of shafts 48, 50 for maintenance and/or replacement without the prior requirement of removing the pump from its mounted operating position and without removing the endplates 14, 16 or gears 52, 54 from the case 12.

As can be seen in FIG. 2, two wearplates 15, 17 are preferably steel and secured by the fasteners 26 between the endplates 14, 16 and the case 12. In particular, the first wearplate 15 is sandwiched between the endplate 14 and the case 12, and the second wearplate 17 is sandwiched between the endplate 16 and the case. Within the pump housing, the wearplates are further sandwiched between the rotatable gears 52, 54 and the stationary endplates and bushings 46. The wearplates have several benefits. For example, the wearplates protect the endplates from damage from the gears making contact or from the pumping media. Further, the wearplate has openings about the shafts 48, 50 that enable the shafts to be removed from the pump with the keys 64 still in place with the shaft. This is achieved by the openings through the wearplate, which are larger in diameter than the diameter of the shaft and the key 64 that protrudes. The size of the openings is the reason for a choke ring 58. The outside diameter of the choke ring is preferably slightly smaller than the inside diameter of the shaft mating openings through the wearplates. The choke ring 58 protrudes from an end of the bushing/seal assembly 46 and passes at least partially through the opening in the wearplate. The choke ring 58 blocks large debris from passing from the interior of pump housing through the opening and potentially causing damage to the bushing/seal assembly 46. The thickness of the wearplates keep the choke ring 58 from making contact with the gears 52, 54.

Still referring to FIG. 2, the upper first type bearing housing 18, second type bearing housing 20 and mounting bracket 22 enclose a drive shaft 48 and supporting components about the drive shaft (e.g., seals 40, 42, bearings 44, bushings 46, choke collar 58, o-rings 60, 62). Further, the lower first type bearing housing 18 and the bearing housing 18 coupled to the second endplate 16 enclose an idler shaft 50 and supporting components about the idler shaft (e.g., seals 40, 42, bearings 44, bushings 46, choke collar 58, o-rings 60, 62). In particular, the bearing housings 18, 20 have an open end defining a bore for mounting a bearing 44 in rotational orientation between the respective bearing housing and one of the drive shafts.

The bushing/seal housing 46 is located within a clearance fit in a channel 56 of the endplate 14, 16 between the choke collar 58 and the bearing 44. An o-ring 60 between the inner boundary wall of the respective endplate 14, 16 and the outer periphery wall of the bushing seals the bushing thereto. The bushing/seal housing includes an outboard end counterbore housing a shaft seal 42, and further houses a second shaft seal 40 on the inner diameter of the bushing. In other words, each bushing has an outer periphery wall, an outboard end defining an outboard counterbore, an inner boundary wall defining a ravine, and an inboard end defining an inboard counterbore. As can best be seen in FIG. 2, each shaft seal 42 is located in the outboard counterbore about the respective drive or idler shaft. The second shaft seal 42 is shown in the ravine of each bushing 46 about the respective drive or idler shaft. A choke collar 58 is set in the inboard counterbore of each bushing about the respective shaft.

While not being limited to a particular theory, the choke collar 58 mounted in the inboard end of each of the four bushing/seal housings 46 is held in place via an interference fit in a counterbore between the outer diameter of the choke collar and an inner diameter of the bushing/seal housing. Preferably the choke collar has a close clearance fit about the outer diameter of the shaft. As can best be seen in FIG. 2, the end of the choke collar 58 nearest its respective gear 52, 54 runs free of contact with the gear, at least in part as defined by the wearplate 15, 17. As shown, the choke collar has an interference fit within the inboard counterbore. Further, the choke collar has a close clearance to light interference fit about the respective drive or idler shaft and a running clearance clear of the respective gear 52, 54. The choke collar prevents and preferably inhibits abrasive particles from entering the seal area of the bushing from the internal cavity of the pump 10.

In order to replace the drive shafts or components, the fasteners 28 are removed from the corresponding bearing housings 18, 20. Removal of one of the bearing housings from its endplate exposes the components on that side of the respective shaft that can then be removed and replaced/repaired/serviced. Removal of both bearing housings corresponding to a respective shaft enables removal of the shaft and its corresponding components.

When the fasteners are removed, the respective bearing housing can then be slipped off of the bearing 44, and the bearing 44 can be slipped off of the shaft to expose the bushing 46 and a spacer ring 66. The bushing 46/seal housing can be slipped from the channel 56 in the endplate 14, 16. The entire bushing/seal housing apparatus including the seals 40, 42, choke collar 58, and spacer ring 66 can be replaced as a completely new unit or in any combination of the apparatus, such as the seals and choke collar may be replaced with new ones in the used bushing/seal housing 46 to be reinstalled in the endplate 14, 16. Preferably the components on both sides of the shaft should be removed before the shaft can be removed.

The spacer ring 66 is added to the pump to extend the sealing capabilities of the shaft. Many times because of the friction caused by the tight fit between the inside diameter of the seal 40, 42 about the rotating shafts outside diameter, a groove may develop over time in the shaft. Once, this groove becomes sufficiently deep the seals 40, 42 will no longer seal. Shifting the spacer ring relative to the bushing 46 relocates the bushing/seal assembly and allows the seals to run against a previously non-grooved area of the shaft. In particular, a new sealing area on the shaft is achieved by moving the spacer ring to the opposite side of the bushing's outer flange. As can be seen in FIG. 2, the bore in the bearing housing 18, 20 that the flanged portion of the bushing/seal assembly fits into is machined to allow for the thickness of the flanged portion of the bearing/seal assembly and the spacer ring 66. While not being limited to a particular theory, the spacer ring 66 is initially installed between the bearing housing 18, 20 and the bushing 46. Upon reassembly, for example during a seal replacement, the spacer ring can be positioned between the bushing 46 and the endplate 14, 16. This will shift the seals to a new portion of the shaft by the distance equal to the thickness of the spacer ring.

Figure 3:
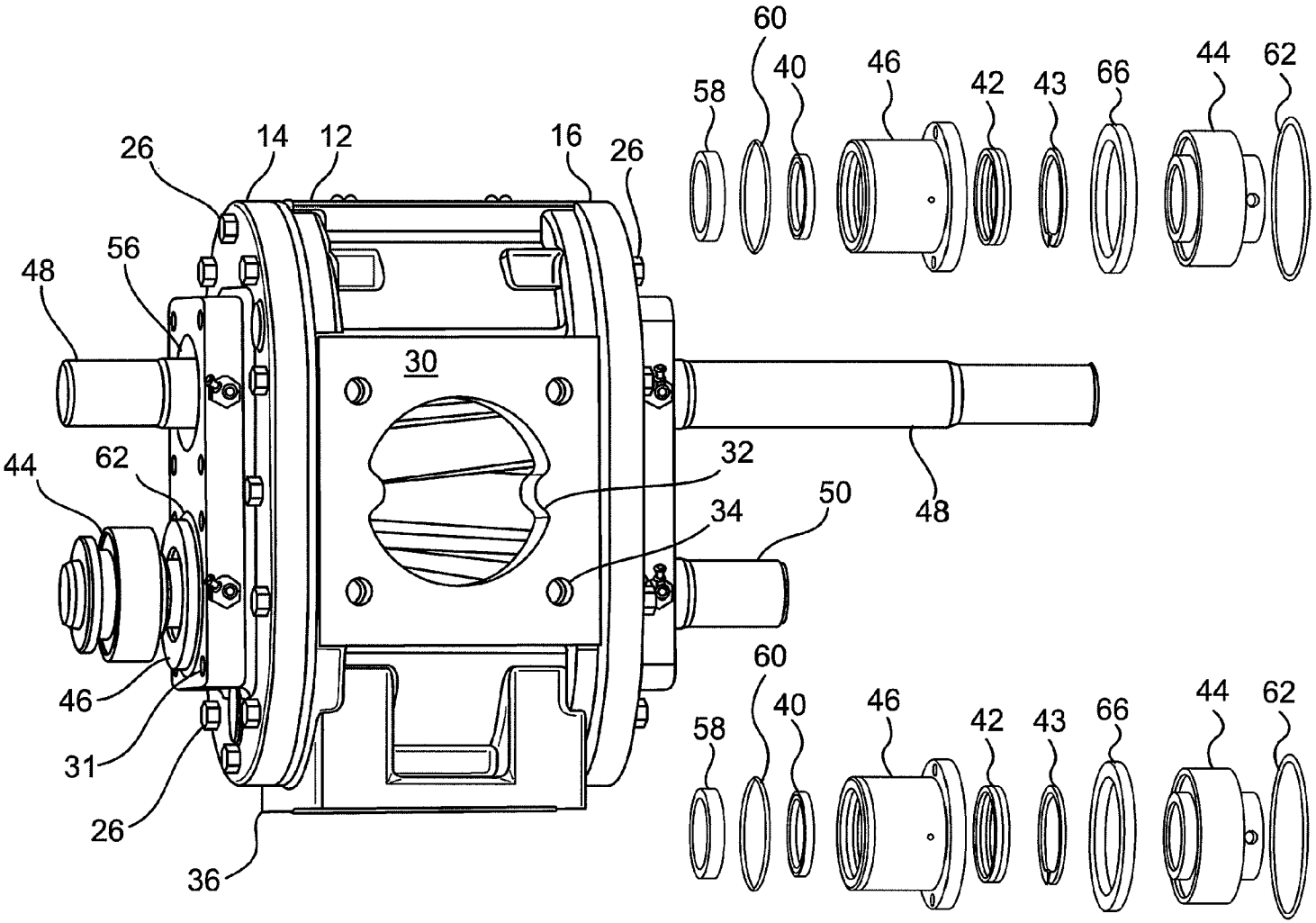
FIG. 3 is a partially exploded perspective view of the pump illustrated in FIG. 1.
Figure 4:
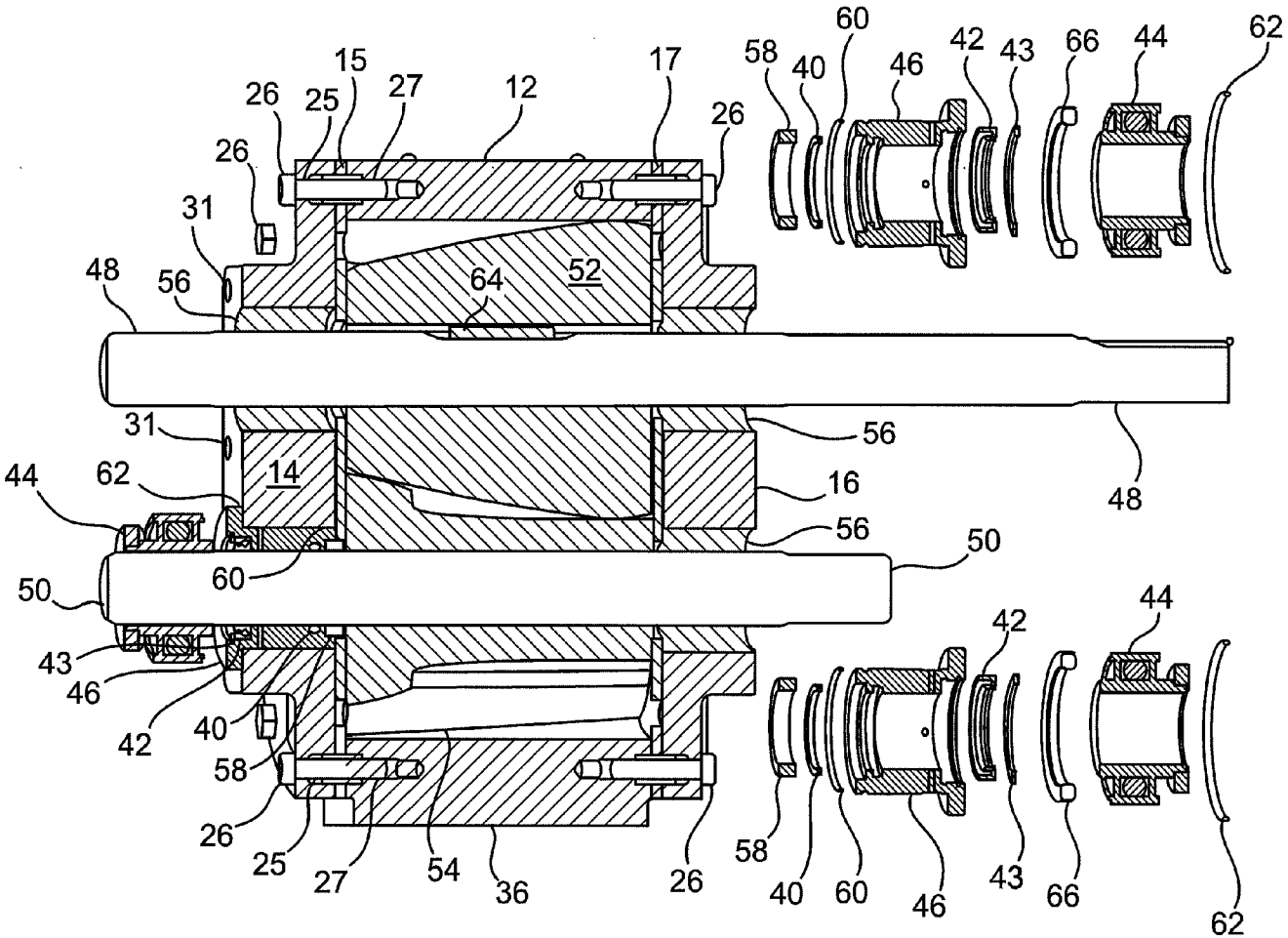
FIG. 4 is a partially exploded sectional view of the pump illustrated in FIG. 3.

FIG. 3 is a partially exploded side view of the pump 10, and FIG. 4 illustrates the pump of FIG. 3 in cross section. These Figs. show the pump 10 with the bearing housings 18, 20 and mounting bracket 22 removed as discussed above, and also with the drive shaft 48 supporting components removed to show the shaft bare adjacent the first endplate 14. The components supporting the idler shaft 50 adjacent the first endplate 14 are left in place about the shaft. Further, FIGS. 3 and 4 show the supporting components of both shafts adjacent the second endplate 16 removed from their respective shaft in exploded view.

When the bearing housings 18, 20 are removed as depicted in FIGS. 3 and 4, the shafts 48, 50 are free to slide out of the gears 52, 54 complete with the key 64 driving the gear without removal of either or both endplates 14, 16 from the pump 10 or without removing the pump from its mounted operating position (e.g., the support bracket 36 and/or the plate wall 30 secured as understood by a skilled artisan). This allows complete shaft and shaft supporting component removal, inspection, maintenance and/or replacement with the pump remaining in its mounted operating position.

These embodiments and the steps taken for removal of the internal parts discussed above are also shown by example in the remaining figures of the instant application, which depict the pump at different stages of internal part removal. Unless otherwise stated, each pump component is made from material as needed for the purpose and application of the specific component, as would be readily understood by a skilled artisan.

While the invention has been described in detail and with reference to specific examples thereof, it will be apparent to one skilled in the art that various changes and modifications can be made therein without departing from the spirit and scope thereof. In other words, the concept of the present invention may be readily applied to a variety of preferred embodiments, including those disclosed herein. For example, it is understood that the invention is not limited to the number of shafts, gears, seals, bushings, o-rings, bearings, bearing housings, collars etc., as the pump may be modified as used for its application. While the invention has been described in detail and with reference to specific examples thereof, it will be apparent to one skilled in the art that various changes and modifications can be made therein without departing from the spirit and scope thereof. Without further elaboration, the foregoing will so fully illustrate the invention that others may, by applying current or future knowledge; readily adapt the same for use under various conditions of service.

What is claimed is:

1. A pump having a modular shaft, bearing and seal design that can be removed while the pump remains in a mounted operating position, the pump comprising:

a pump housing including a case, first and second endplates, and first and second bearing housings, the first and second endplates being attached to the case on opposite ends thereof and forming an internal cavity for enclosing a gear, the first and second endplates each having a channel and a plurality of endplate bores adjacent the channel, the channel of the first endplate in axial alignment with the channel of the second endplate, the first and second bearing housings each having an open end defining a bearing bore and an aperture adjacent the bearing bore and in alignment with one of the endplate bores, the first bearing housing attached to the first endplate via a fastener extending through the first bearing housing aperture and coupling with the first endplate bore, the second bearing housing attached to the second endplate via a fastener extending through the second bearing housing aperture and coupling with the second endplate bore;

a drive shaft extending through the channels of the first and second endplates and into the first and second bearing housings, the drive shaft having a clearance fit within the gear, the drive shaft including a key extending outwards into abutment with the gear to drive the gear; and first and second bushings located about the drive shaft, the first bushing located between the drive shaft and the channel of the first endplate, the second bushing located between the drive shaft and the channel of the second endplate, wherein detachment of one of the first and second bearing housings from the respective endplate while the endplate remains attached to the case enables removal of the bushing adjacent the detached bearing housing.

2. The pump of claim 1, wherein detachment of the other of the first and second bearing housings from the respective endplate while the endplate remains attached to the case enables removal of the bushing adjacent the detached other bearing housing and removal of the drive shaft.

3. The pump of claim 1, further comprising a plurality of o-rings, the bearing housings including a groove at the open end thereof, the first o-ring fitting in the groove of the first bearing housing to seal the first bearing housing against an outer wall of the first endplate, the second o-ring fitting in the groove of the second bearing housing to seal the second bearing housing against an outer wall of the second endplate.

4. The pump of claim 1, the first bearing housing having a closed end opposite the open end, and the second bearing housing having a second end opposite the open end, the second end having a bore through which the end of the drive shaft extends.

5. The pump of claim 1, the bushing having an outboard end defining an outboard counterbore, an inner tubular wall defining a ravine, and an inboard end defining an inboard counterbore, the pump further comprising a shaft seal about the drive shaft in the outboard counterbore, a shaft seal about the drive shaft in the ravine, and a choke collar about the drive shaft in the inboard counterbore.

6. The pump of claim 5, the choke collar having an interference fit within the inboard counterbore of the bushing, the choke collar further having a close clearance to light interference fit about the drive shaft and a running clearance clear of the gear, the choke collar preventing abrasive particles from entering the seal area of a bushing from the internal cavity of the pump.

7. The pump of claim 1, further comprising first and second wearplates, the first wearplate being adjacent the first endplate and separating the first endplate from the gear, the second wearplate being adjacent the second endplate and separating the second endplate from the gear.

8. The pump of claim 1, further comprising a spacer ring adjacent the first bushing and relocatable from a first position between the first bearing housing and the first bushing to a second position between the first bushing and the first endplate.

9. A pump having a modular shaft, bearing and seal design that can be removed while the pump remains in a mounted operating position, the pump comprising:

a pump housing including a case, first and second endplates, and a plurality of bearing housings, the first and second endplates being attached to the case on opposite ends thereof and forming an internal cavity for enclosing a drive gear and an idler gear, the first and second endplates each having an upper channel, a lower channel and a plurality of endplate bores adjacent the upper and lower channels, the channels of the first endplate in axial alignment with the channels of the second endplate, the bearing housings each having an open end defining a bearing bore and apertures adjacent the bearing bore and in alignment with one of the endplate bores, the bearing housings attached to the endplates via fasteners extending through the apertures of the bearing housings and coupling with the endplate bores;

a drive shaft extending through the upper channels of the first and second endplates and into the respectively attached bearing housings, the drive shaft having a clearance fit within the drive gear, the drive shaft including a key extending outwards into abutment with the drive gear to drive the gear;

an idler shaft extending through the lower channels of the first and second endplates and into the respectively attached bearing housings, the idler shaft fit within the idler gear;

first and second of the plurality of bushings located about the drive shaft, the first bushing located between the drive shaft and the channel of the first endplate, the second bushing located between the drive shaft and the channel of the second endplate; and third and fourth of the plurality of bushings located about the idler shaft, the third bushing located between the idler shaft and the channel of the first endplate, the fourth bushing located between the idler shaft and the channel of the second endplate, wherein detachment of one of the bearing housings from the respective endplate while the endplate remains attached to the case enables removal of the respective one of the drive and idler shaft exposed by the detachment and removal of the bushings about the respective shaft adjacent the detached bearing housing.

10. The pump of claim 9, wherein detachment of another of the bearing housing from the endplate opposite the respective endplate and coaxial with the one detached bearing housing exposes one of the shafts and enables removal of the bushing adjacent the another detached bearing housing and removal of the exposed shaft.

11. The pump of claim 9, further comprising two of the bearings located about the drive shaft and two of the bearings located about the idler shafts, each of the bearings in abutment within a different one of the plurality of bearing housings.

12. The pump of claim 9, further comprising a plurality of o-rings, each of the bearing housings including a groove at the open end thereof, one of the o-rings fitting in the groove of each bearing housing to seal the bearing housing against an outer wall of one of the endplates.

13. The pump of claim 9, each bushing having an outboard end defining an outboard counterbore, an inner tubular wall defining a ravine, and an inboard end defining an inboard counterbore, the pump further comprising a shaft seal about the drive shaft in the outboard counterbore, a shaft seal about the drive shaft in the ravine, and a choke collar about the drive shaft in the inboard counterbore.

14. The pump of claim 13, the choke collar having an interference fit within the inboard counterbore, the choke collar further having a close clearance to light interference fit about the drive shaft and a running clearance clear of the gear, the choke collar preventing abrasive particles from entering the seal area of the bushing from the internal cavity of the pump.

15. The pump of claim 9, further comprising first and second wearplates, the first wearplate being adjacent the first endplate and separating the first endplate from the drive and idler gears, the second wearplate being adjacent the second endplate and separating the second endplate from the drive and idler gears.

16. The pump of claim 9, further comprising a spacer ring adjacent the first bushing and relocatable from a first position between the adjacent bearing housing and the first bushing to a second position between the first bushing and the first endplate.

* * * * *